US006364820B1

(12) United States Patent
Jostler et al.

(10) Patent No.: US 6,364,820 B1
(45) Date of Patent: Apr. 2, 2002

(54) FORMING DEVICE AND METHOD FOR FORMING A HOSE INTO A WEB WITH MUTUALLY SEQUENTIAL PACKAGING BLANKS AND SUCH A HOSE

(75) Inventors: Jan Jostler; Ingemar Brodén, both of Halmstad (SE)

(73) Assignee: Joker System AB, Halmsted (SE)

( * ) Notice: Subject to any disclaimer, the term of this patent is extended or adjusted under 35 U.S.C. 154(b) by 0 days.

(21) Appl. No.: 09/445,277

(22) PCT Filed: May 27, 1998

(86) PCT No.: PCT/SE98/00998

§ 371 Date: Dec. 20, 1999

§ 102(e) Date: Dec. 20, 1999

(87) PCT Pub. No.: WO98/55360

PCT Pub. Date: Dec. 10, 1998

(30) Foreign Application Priority Data

Sep. 5, 1997 (SE) ..... 9702133

(51) Int. Cl.[7] ..... B31B 1/90

(52) U.S. Cl. ..... 493/214; 493/227; 493/223

(58) Field of Search ..... 493/186, 194, 493/199, 223, 214, 227, 269; 53/469

(56) References Cited

U.S. PATENT DOCUMENTS

| | | | | |
|---|---|---|---|---|
| 3,978,638 A | | 9/1976 | Sether | 53/30 |
| 4,054,016 A | | 10/1977 | Van Keulen | 53/64 |
| 4,558,556 A | * | 12/1985 | Jostler | |
| 4,654,878 A | * | 3/1987 | Lems | |
| 4,665,552 A | | 5/1987 | Lems et al. | 383/37 |
| 5,722,218 A | * | 3/1998 | Lerner | |
| 5,830,118 A | * | 11/1998 | Nicholson | |
| 6,021,628 A | * | 2/2000 | Jostler et al. | |

FOREIGN PATENT DOCUMENTS

| | | |
|---|---|---|
| SE | 505067 | 6/1997 |
| WO | 8200129 | 1/1982 |
| WO | 9117086 | 11/1991 |
| WO | 9312008 | 6/1993 |
| WO | 9712816 | 4/1997 |

* cited by examiner

*Primary Examiner*—Eugene Kim
(74) *Attorney, Agent, or Firm*—Landas & Parry

(57) ABSTRACT

A hose (1) of a flexible plastic material is designed so as to be reformed into a web (2) with mutually sequential packaging blanks (26) separated by transverse slits (27). The hose has a region (15) oriented in the longitudinal direction which is cut on the formation of the web (2). At least one longitudinal thickening (14) is included in region (15). A device for reforming the hose (1) into the web (2) has retainer devices (33*a*, 33*b*) provided with a channel having a gap whose width exceeds the thickness of two adjacent hose walls (11*a*, 11*b*). A slitting device is located in the channel. Cutting and welding devices (37, 39) form the transverse and longitudinal slits (27, 29) and also form transverse connecting zones between the walls (11, 11*b*) on either side of each transverse slit (27).

22 Claims, 12 Drawing Sheets

FORMING DEVICE AND METHOD FOR FORMING A HOSE INTO A WEB WITH MUTUALLY SEQUENTIAL PACKAGING BLANKS AND SUCH A HOSE

The present invention relates to a hose of flexible material which is suitable to be reformed into a web comprising sequentially disposed packaging blanks (pockets), and also relates to a method and a device for reforming the hose into the web and for supplying contents to the pockets of the web.

There is a need in the art for a hose of flexible material suitable to be reformed into a web comprising pockets sequentially disposed in the longitudinal direction of the web, in which the web is disposed to be displaced along mechanical retainer devices which, during a portion of the displacement, hold the pockets in the open position in order to make it possible to supply contents to the pockets, whereafter the retainer devices on continued displacement of the web generally hold the pockets in a position in which closure of the pockets takes place.

EP-B1 0 054 564 describes a web of the above disclosed type. The web displays two opposing walls and longitudinal, first (lower) and second (upper) edges. The web comprises sequentially disposed pockets with a bottom portion at the first edge and two connection zones which are transverse in relation to the longitudinal direction of the web and which form the side closures of the pockets. Transverse slits are provided between the connection zones in two adjacent pockets in order to separate the pockets from one another.

The web according to EP-B1 0 054 564 includes two substantially opposing belt portions which extend in the longitudinal direction of the web at its above mentioned upper edge. The belt portions are provided with tunnels disposed in the longitudinal direction of the web, for co-operation with mechanical retainer devices along which the web is displaced. When contents are to be supplied to the pockets, the mechanical retainer devices guide the belt portions to positions in which the belt portions are located in spaced apart relationship from another, the pockets being opened. In both walls, the web is provided with slits disposed in the longitudinal direction of the web which facilitate the opening of the pockets.

The above-disclosed technology employs a web which already includes those pockets which are to be supplied with contents. One drawback in this context is that the user of the web (the filler) is allowed no option for the dimensions of the pockets of the web and the length of the slits disposed in the longitudinal direction of the web. Consequently, the filler must have a store of webs in different designs in order to be able to employ pockets of dimensions and slits disposed in the longitudinal direction of the web of such a length in which the dimensions of the pockets and the length of the slits are adapted to the size and configuration of the products which are to be supplied into the pockets. As a result, the flexibility of the filler is restricted and the need for webs of different designs moreover entails undesirable, high storage costs.

A technology which, to a high degree obviates the above-outlined drawbacks is defined in the characterizing clauses of the independent claims.

The present invention makes it possible, on reforming of the hose into the web, to adapt the size of the pockets in response to the contents which are to be supplied to them. By modifying the distance between the transverse slots, the width of the pockets is modified. By modifying the length and placement of the slits in the longitudinal direction of the web which are required for opening the pockets, the configuration and size of the openings of the pockets will be regulated. Even if the filler cannot employ only one hose size (diameter), the present invention entails a substantial reduction of the number of hose diameters required as compared with the number of embodiments of webs which were previously required.

Expedient embodiments of the present invention are disclosed in the appended subclaims.

The present invention will be now described in greater detail hereinbelow with reference to a number of figures, in which:

FIG. 1 shows a portion of a hose;

FIG. 1*a* shows a cross-section taken along the line a—a in FIG. 1;

FIGS. 1*b–f* are cross-sections corresponding to the upper portion of the cross-section a—a in embodiments of the hose;

Figure 3:
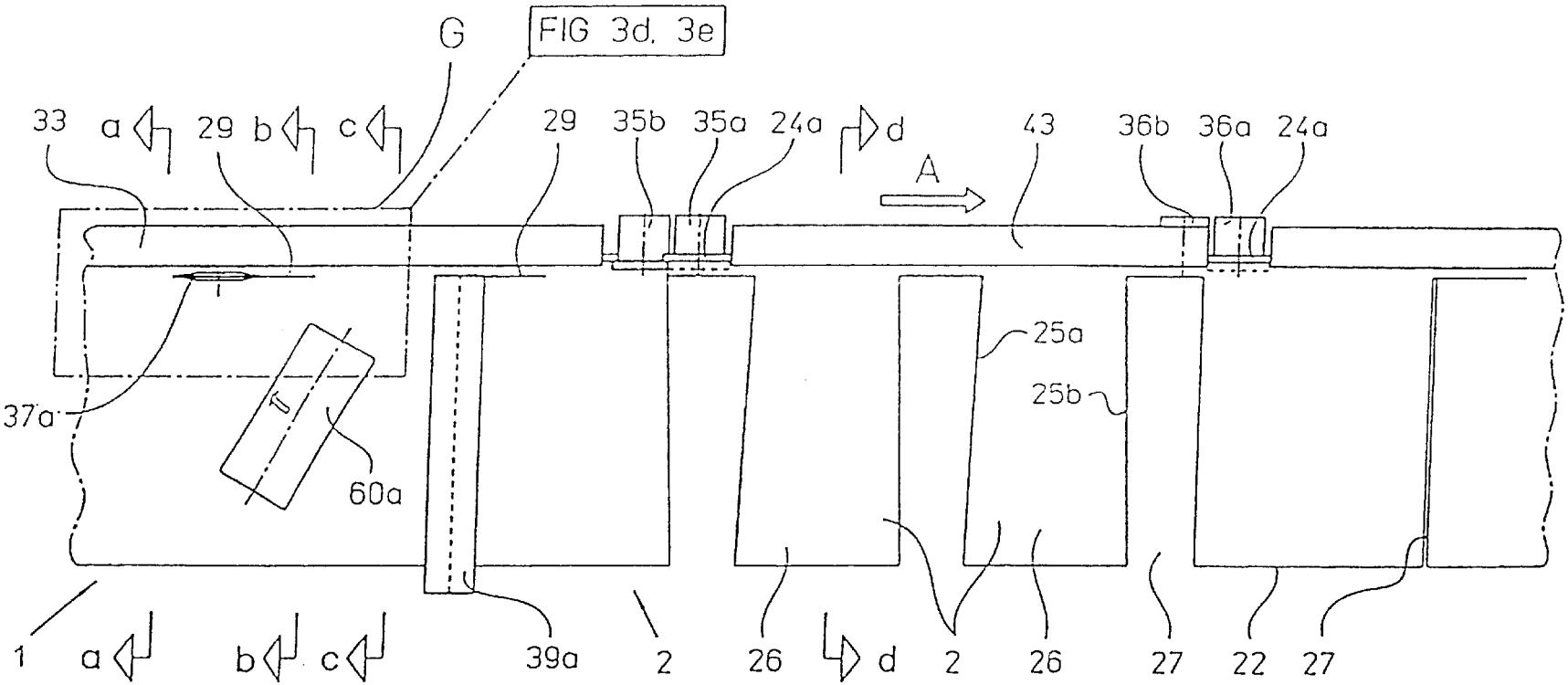
FIG. 3 is a side elevation of the device according to FIG. 2.
Figure 3C:
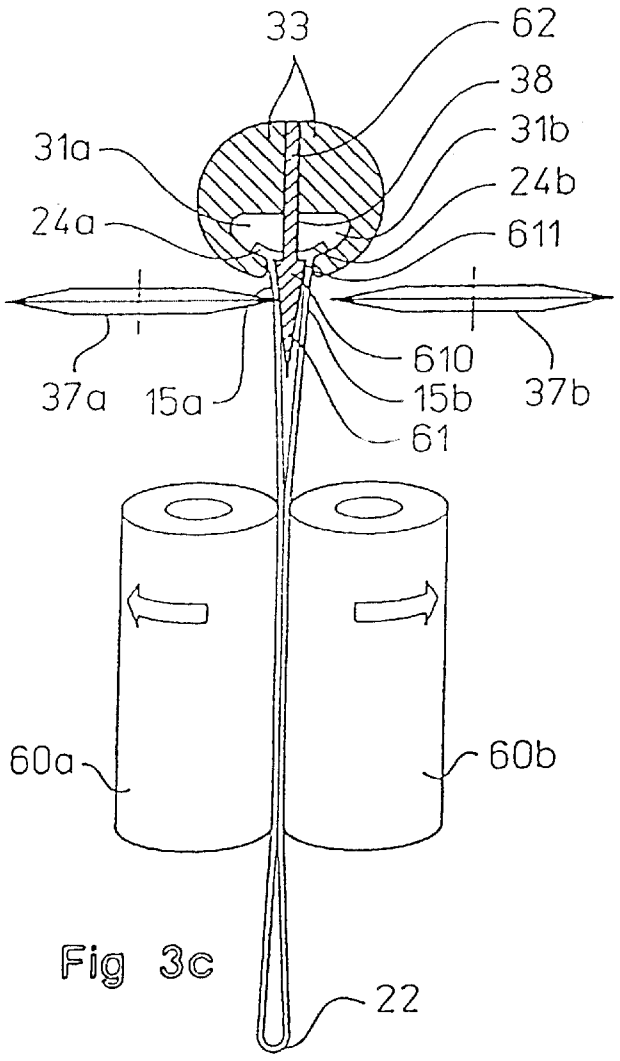
Figure 3B:
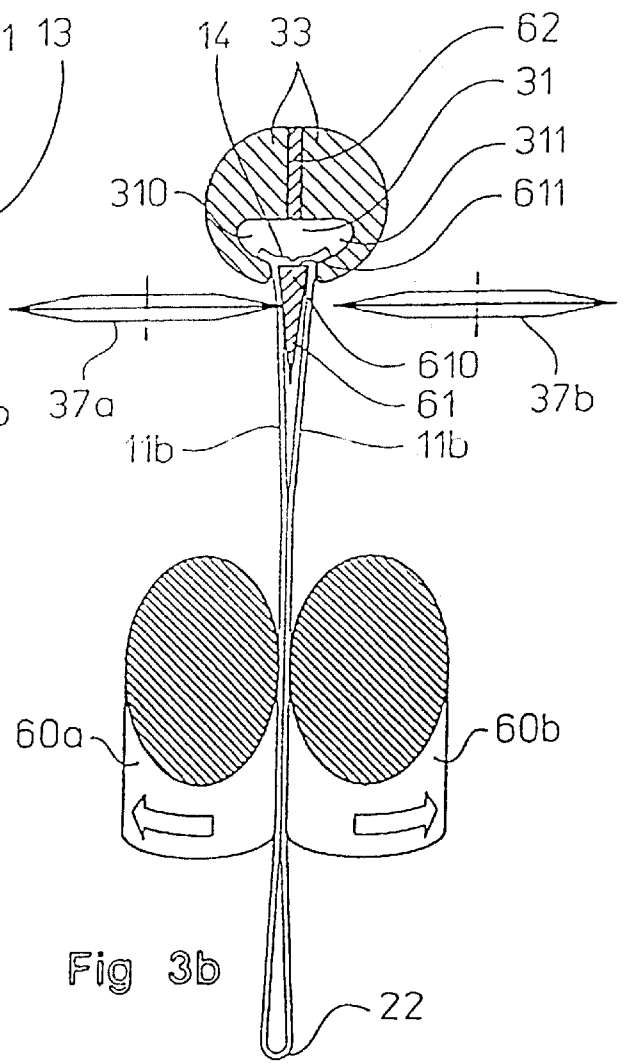
Figure 3A:
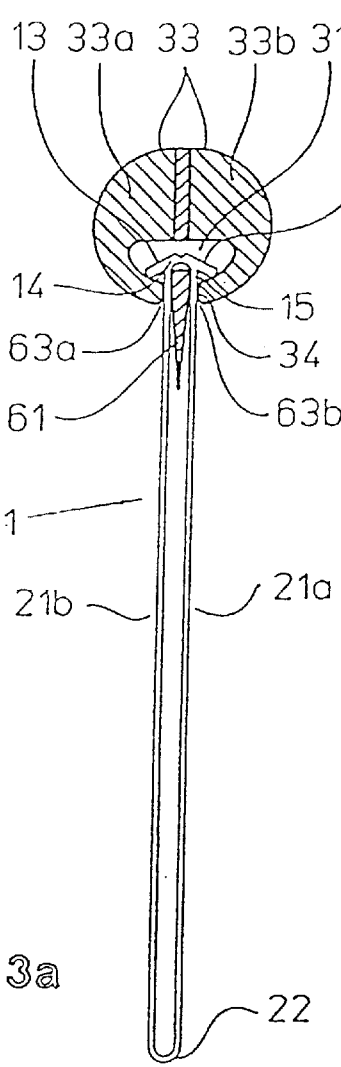
Figure 3D:
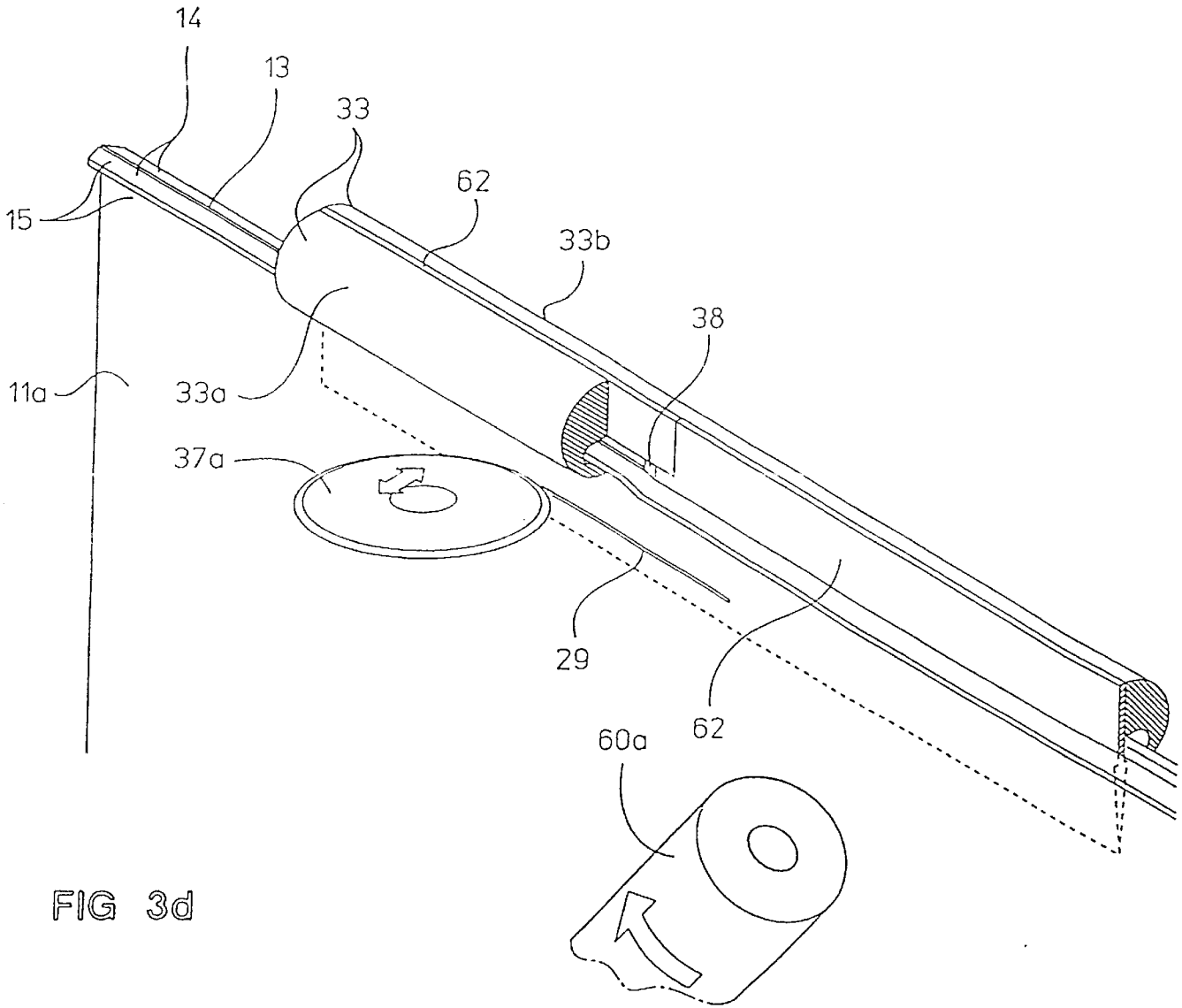
Figure 3E:
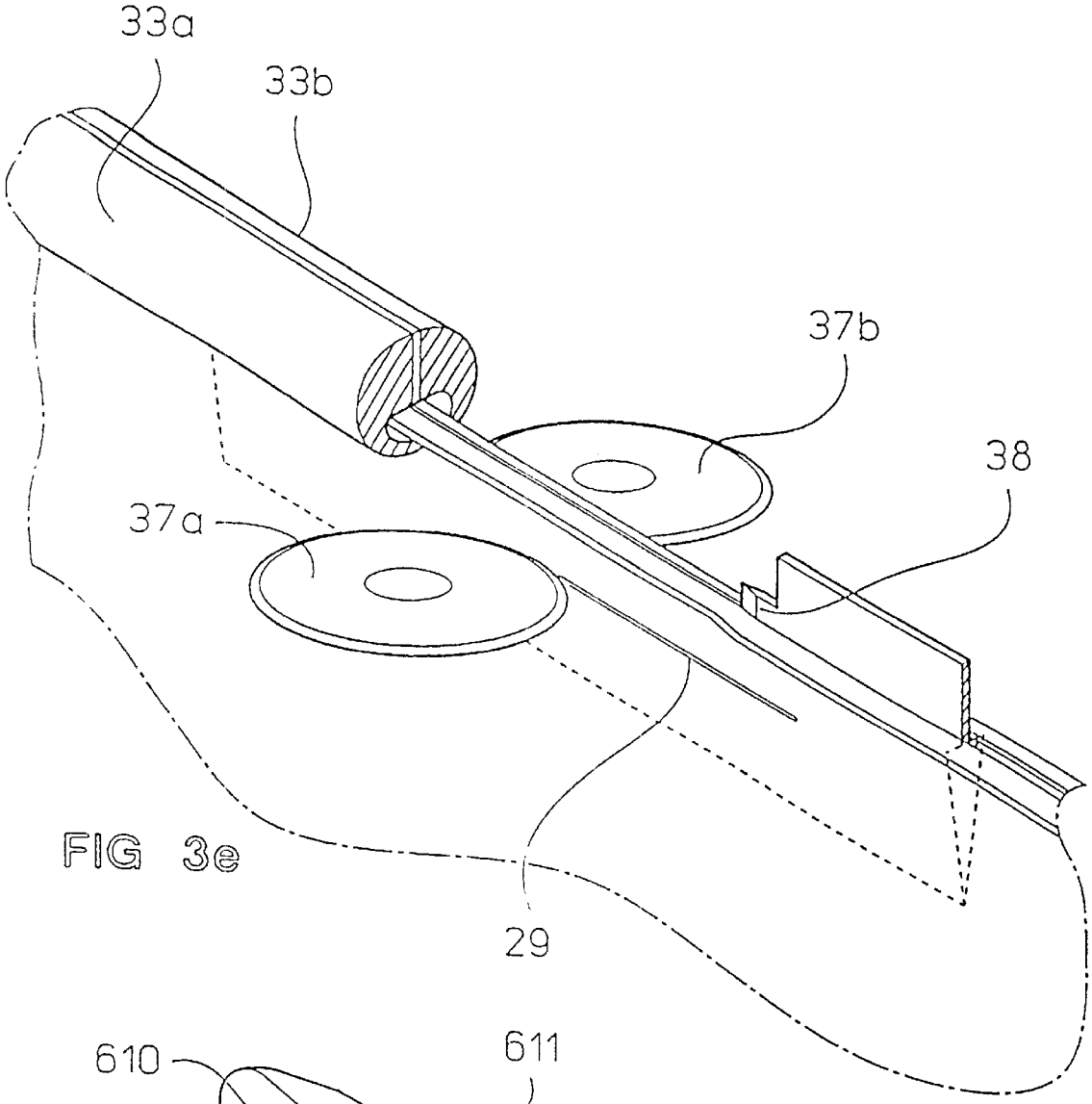
Figure 3F:
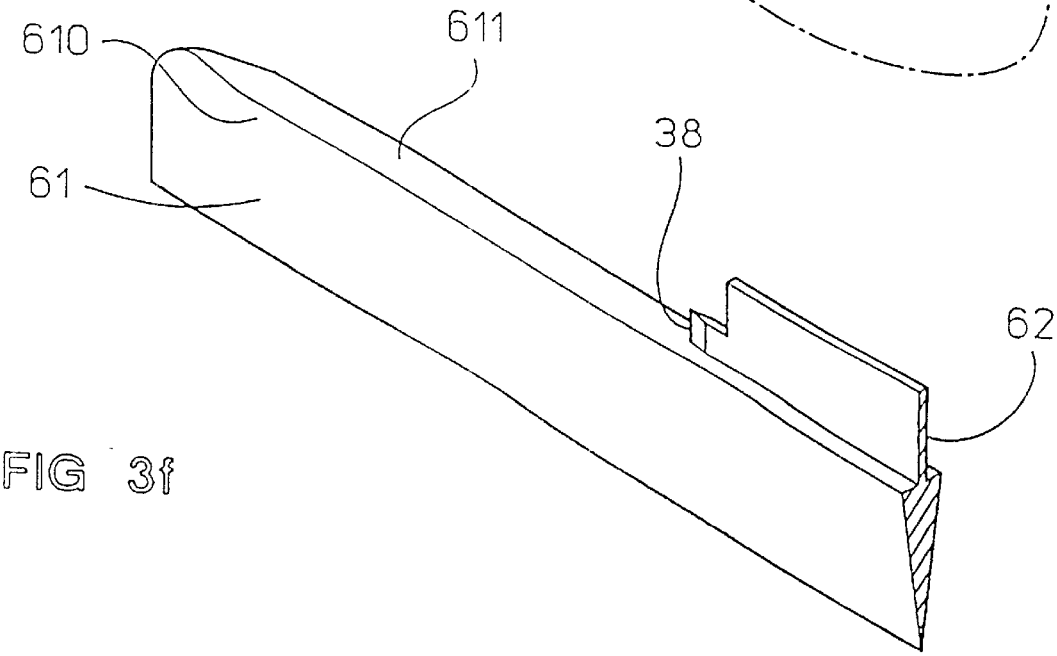

FIGS. 3*a–c* are sections taken along the lines a—a, b—b, and c—c in FIG. 3;

FIG. 3*d* is a partly cut-out detailed illustration of the region G in FIG. 3;

FIGS. 3*e–f* are partly cut-out detailed illustrations showing carrier devices, cutter devices and knives included in the region G.

Figure 1A:
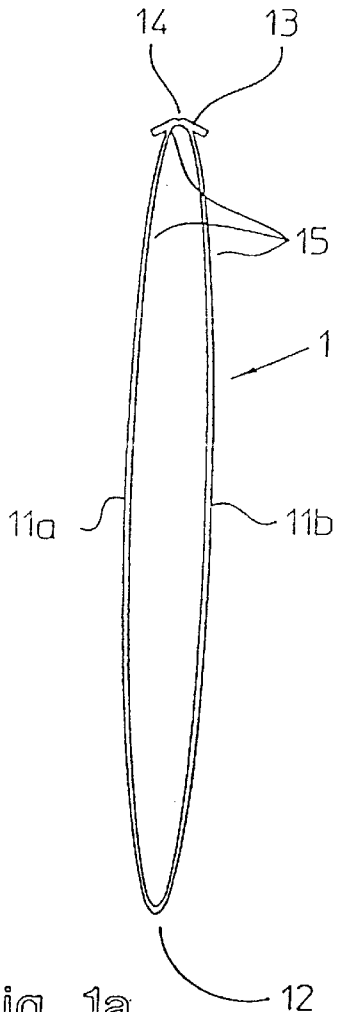
Figure 1:
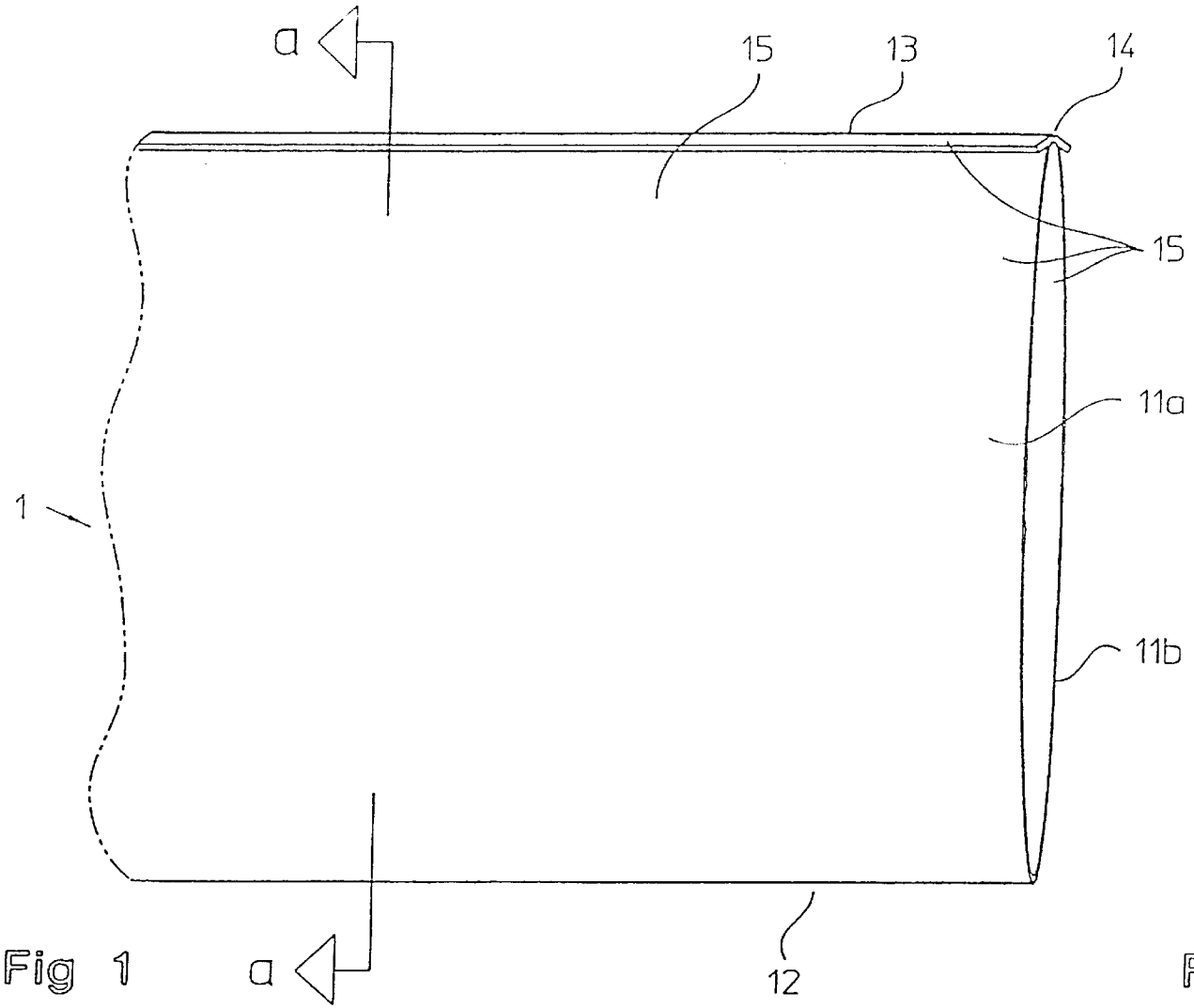
Figure 1B:
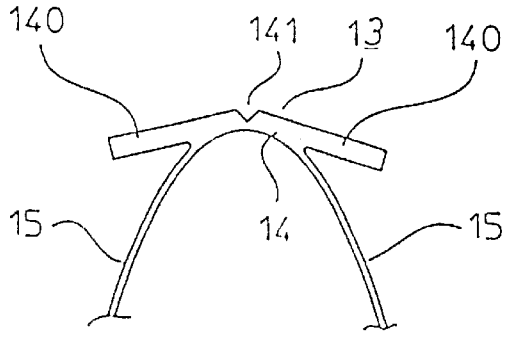
Figure 1C:
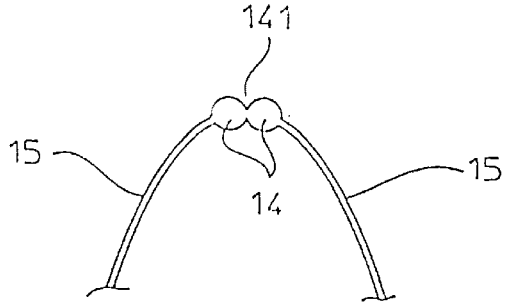
Figure 1D:
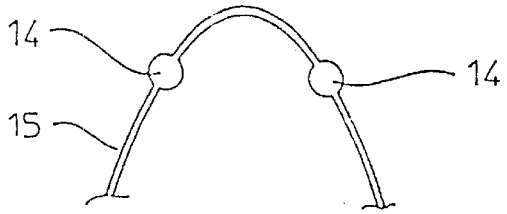
Figure 1E:
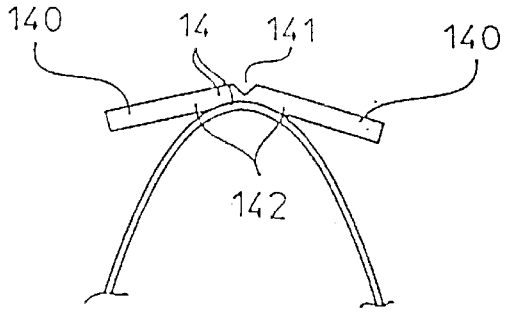
Figure 1F:
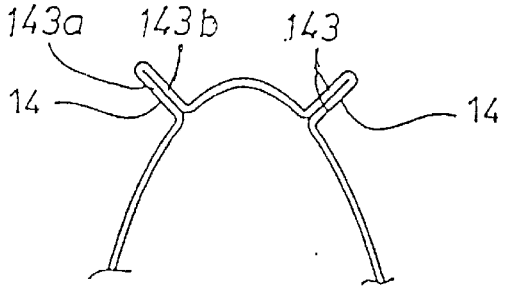
Figure 4A:
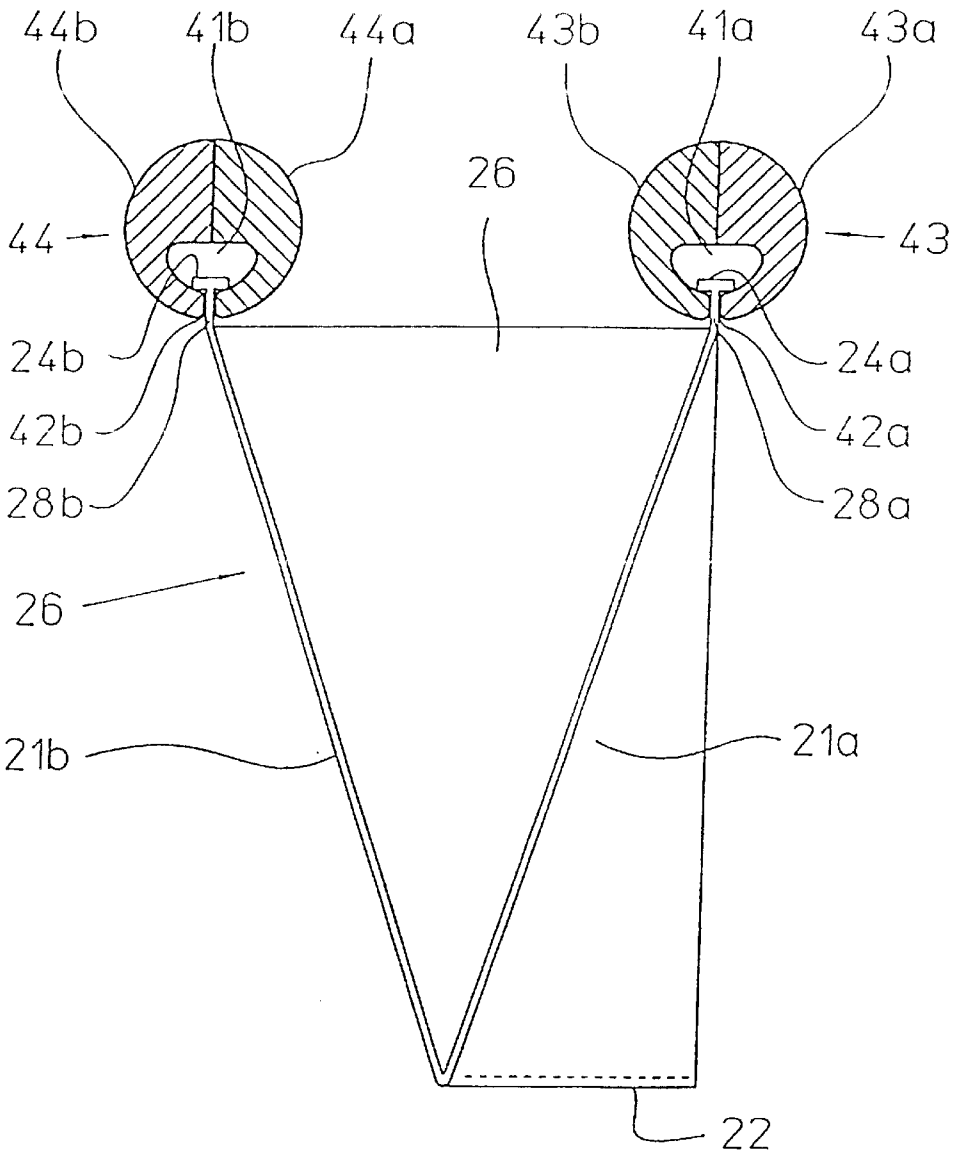
Figure 4C:
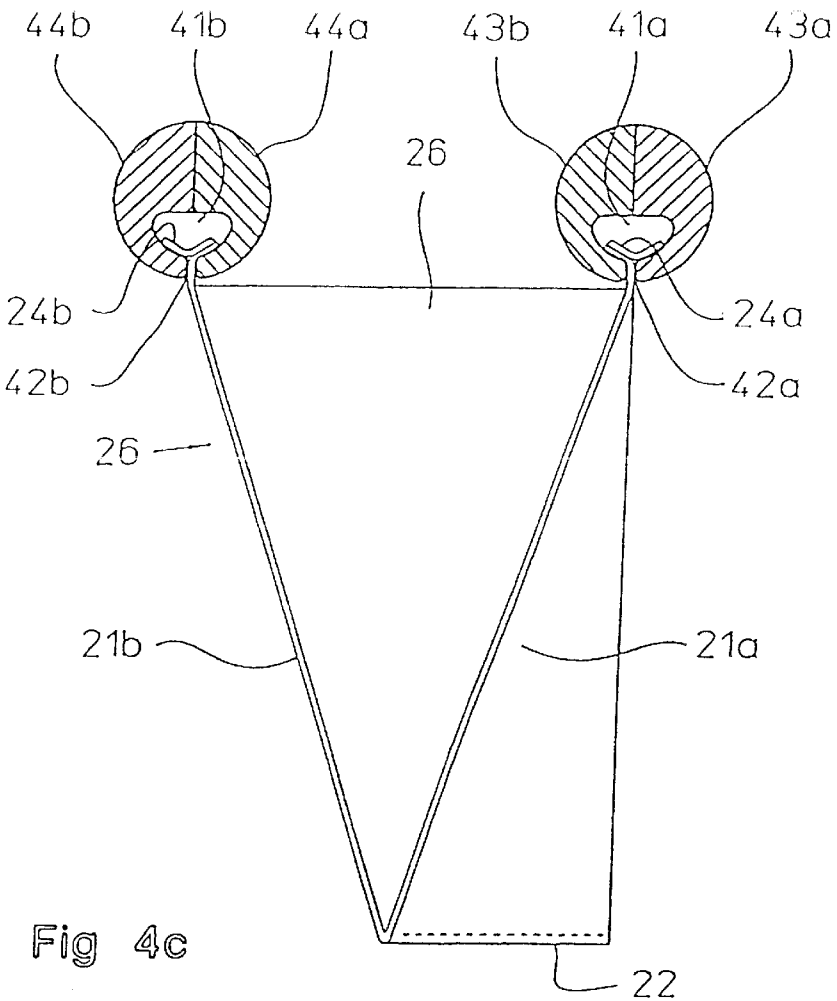
Figure 4B:
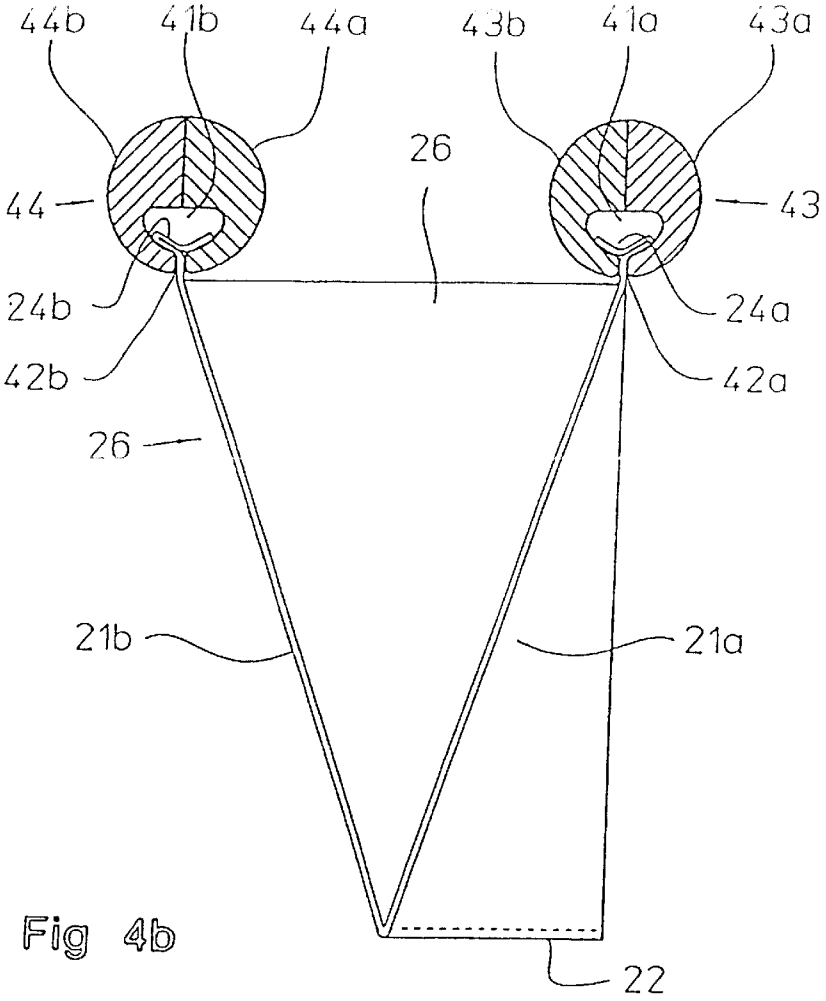

FIGS. 4*a–c* show the section d—d in FIG. 3 for those embodiments of the hose illustrated in FIG. 1*b*, 1*f* and 1*e;*

Figure 2:
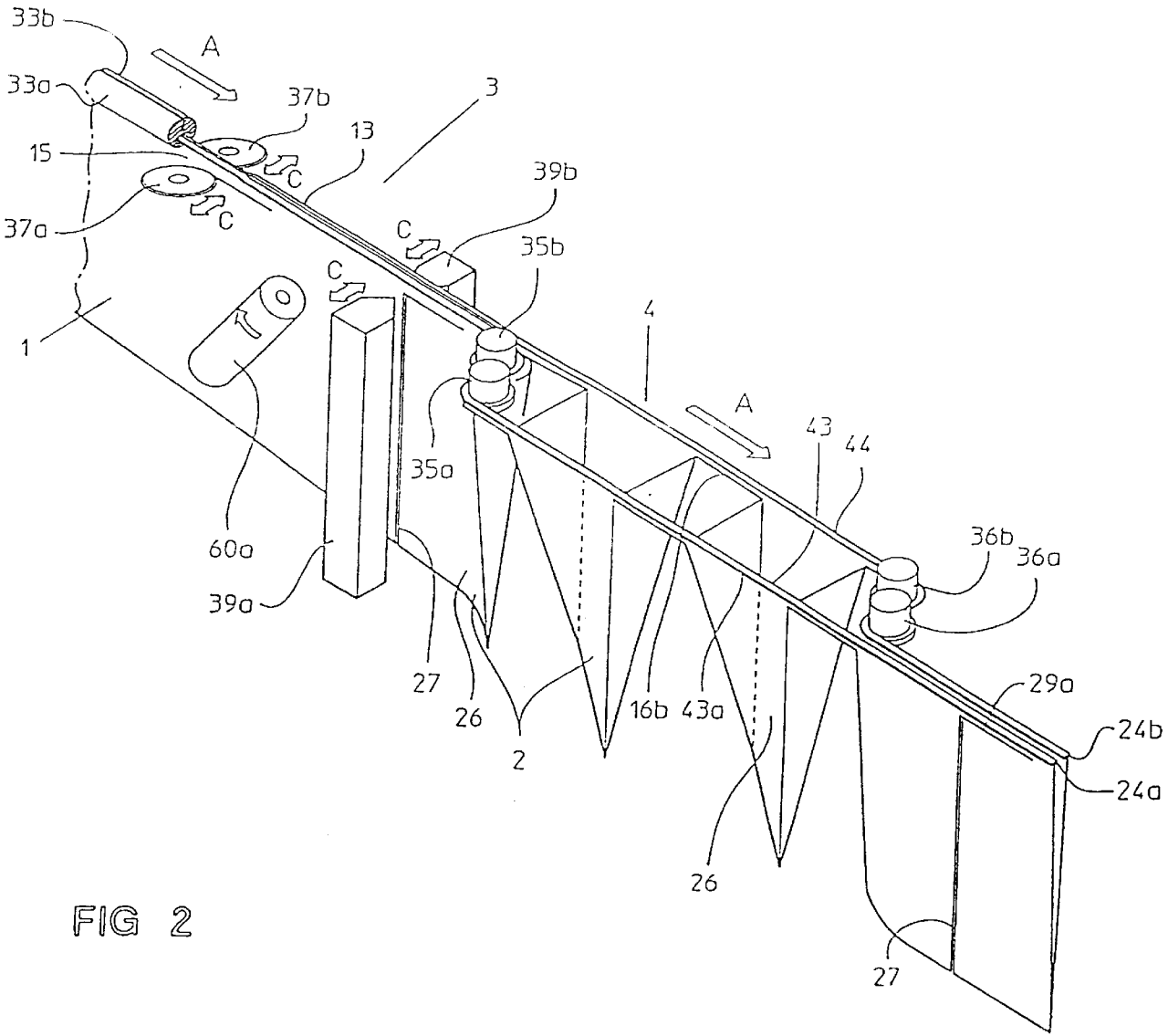
FIG. 2 is a partially cut-out perspective view of a first embodiment of a device for reforming the hose into a first embodiment of a web which forms sequentially disposed pockets, and for opening and closing the pockets of the web.
Figures 5, 5A, 5B, 5C:
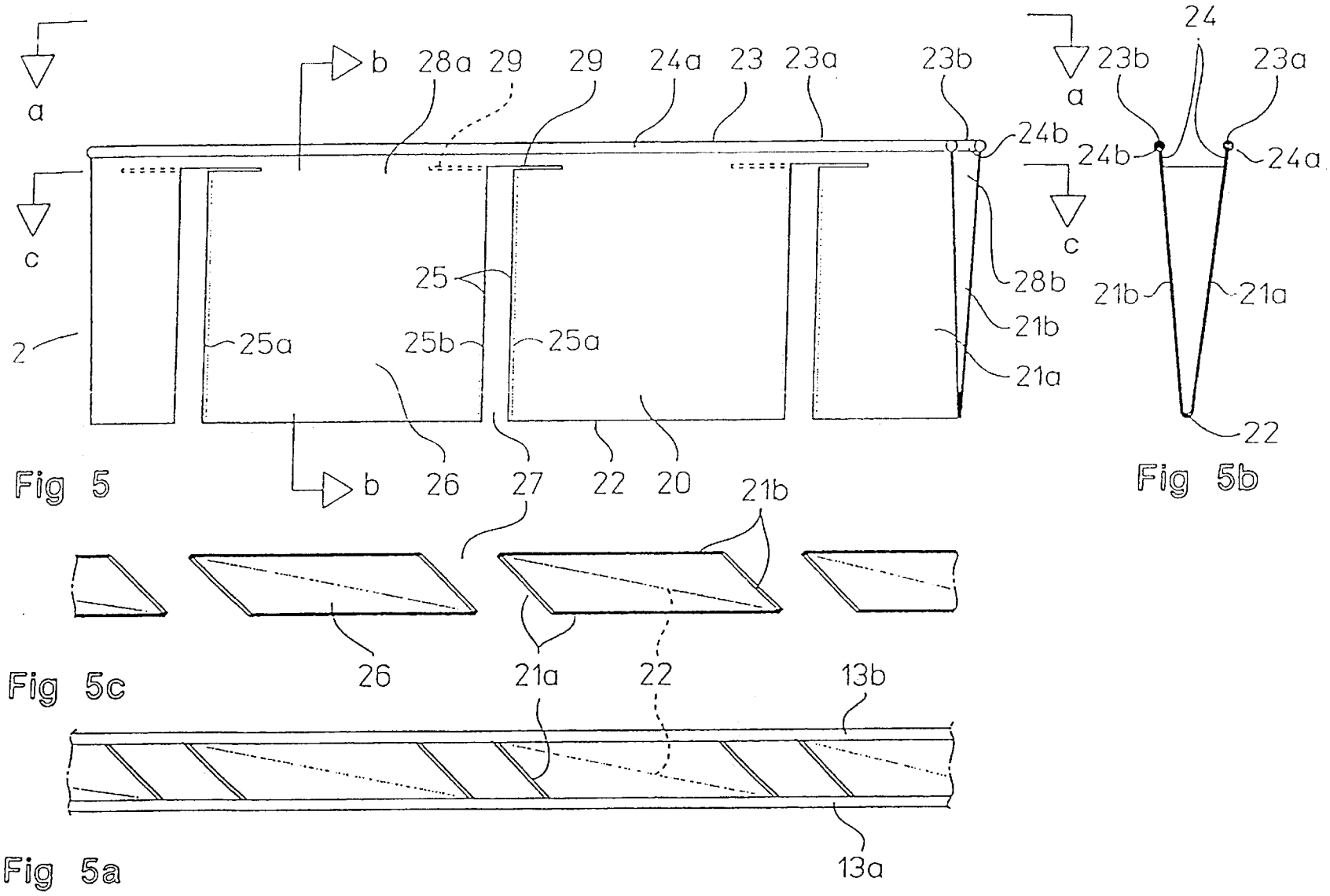
Figures 6, 6A, 6B, 6C:
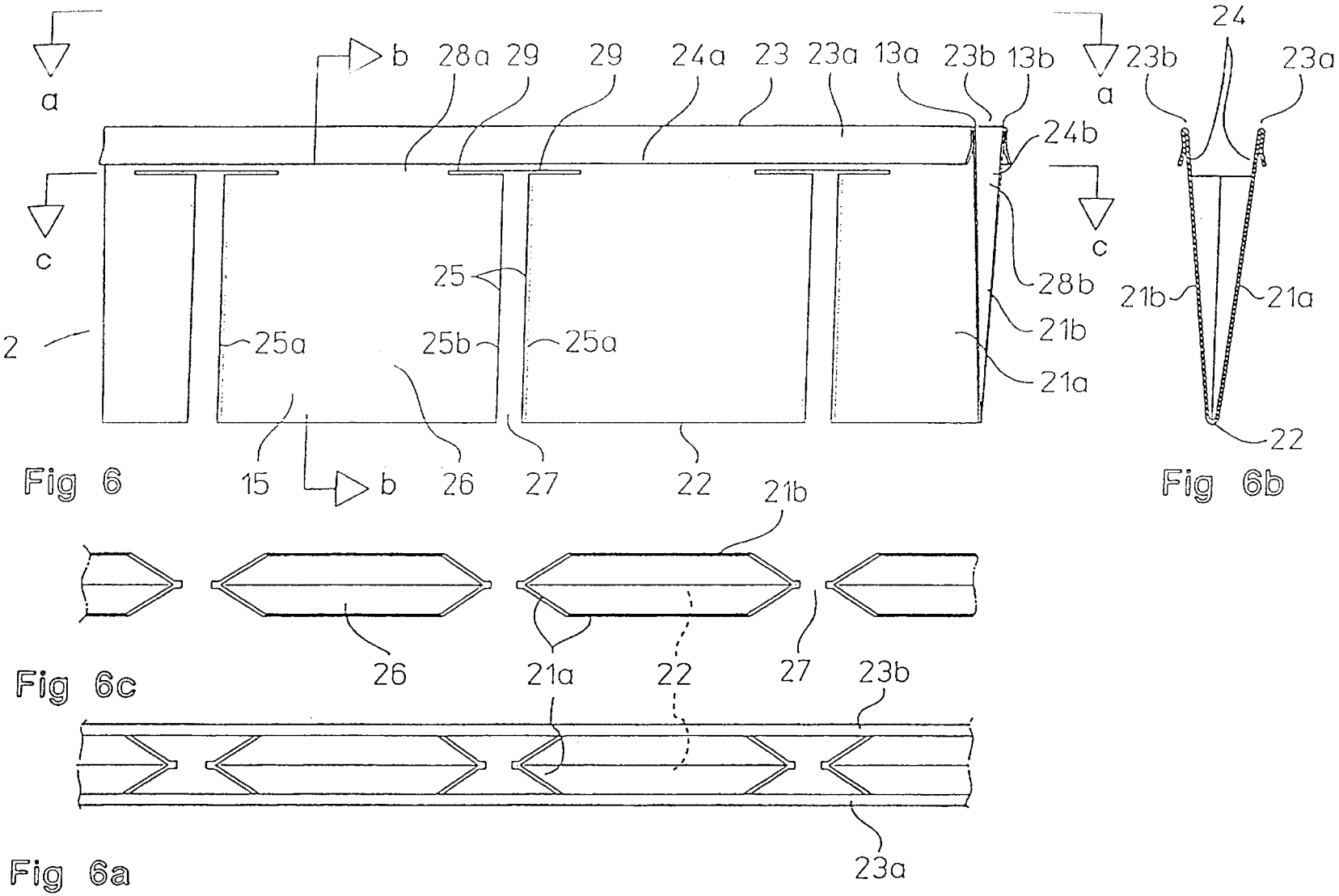
Figure 7:
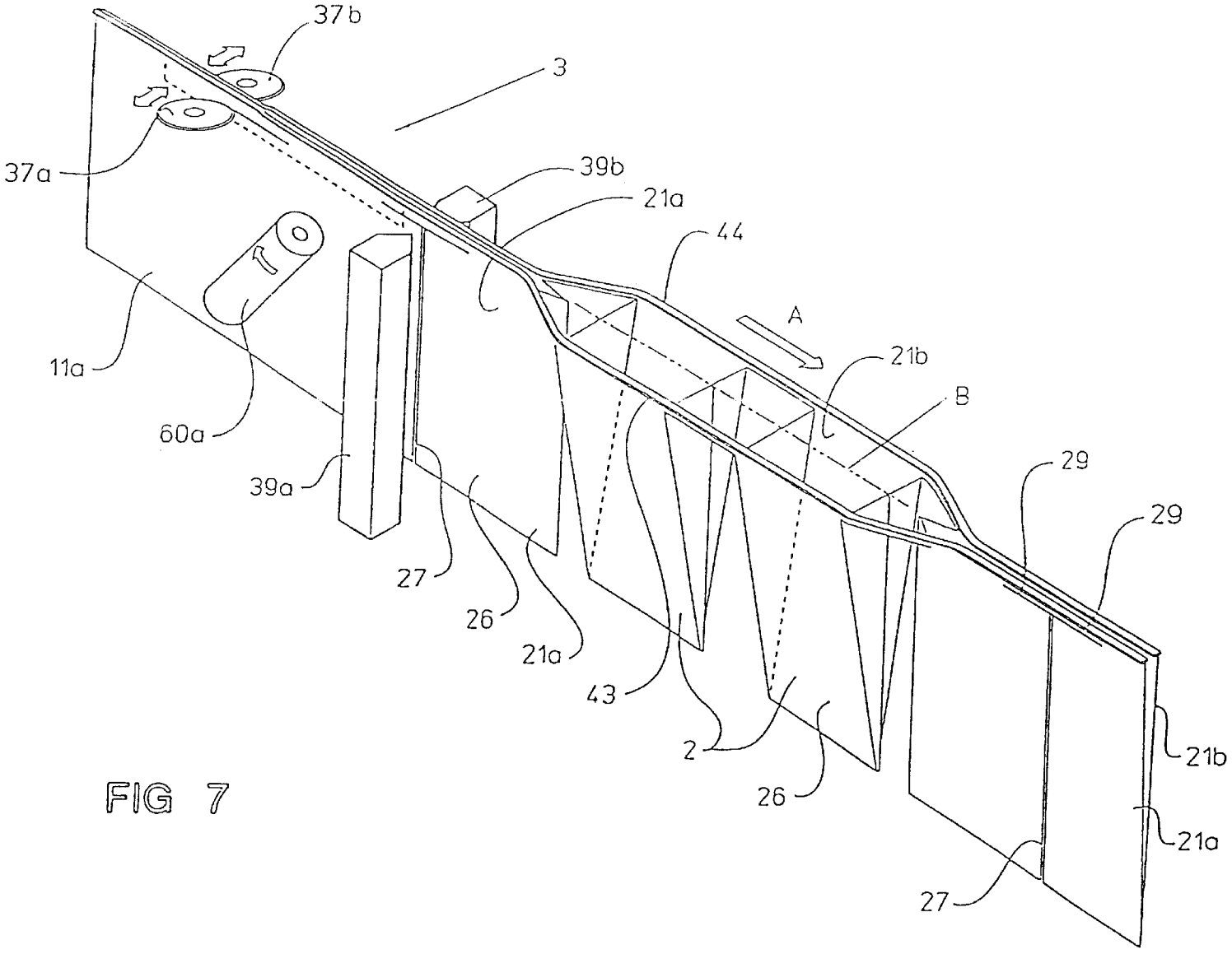

FIG. 5 is a side elevation of the first embodiment of the web formed by the hose, with the pockets of the web opened and in which the web is adapted to be used in the device according to FIG. 2;

FIG. 5*a* is a top plan view of the web according to FIG. 5;

FIGS. 5*b–c* are the sections b—b and c—c in FIG. 5;

FIG. 6 is a side elevation of a second embodiment of the web formed by the hose, with the pockets of the web opened and in which the web is adapted to be used in the device according to FIG. 7;

FIG. 6*a* is a top plan view of the web according to FIG. 6;

FIGS. 6*b–c* show the sections b—b and c—c in FIG. 6; and

FIG. 7 is a partly cut-out perspective view of a second embodiment of a device for reforming the hose into the second embodiment of the web forming sequentially disposed pockets and for opening and closing of the pockets of the web.

In FIGS; 1 and 1*a–f* are shown a hose 1 of flexible material, generally plastic material or similar material designed so as to be reformed into a web 2 described below which includes mutually sequential packaging blanks 26, hereinafter generally designated pockets 26. The term "similar material" is taken to signify any optional material with such properties that a hose of the material is suitable for use in application of the present invention as herein described. A hose whose wall is; provided with perforations or consists of a net also constitutes examples of a hose which is suitable to be used in the application of the present invention. In FIGS. 1, 1*a*, the hose is shown as flattened, which is the form the hose generally assumes in connection with manufacture, irrespective of whether the hose is rolled up on a bobbin or is staggered.

In the flattened form illustrated in FIGS. 1, 1*a–f*, the hose displays two opposing walls, 11*a*, 11*b*; hereinafter also referred to as first wall 11*a* and second wall 11*b*. In its longitudinal direction, the hose has a first (lower) edge 12 and second (upper) edge 13. In the embodiments shown in the drawings, the upper edge of the hose is provided with one or more thickened material portions 14 oriented in the longitudinal direction of the hose, hereinafter generally referred to as thickenings. It will be obvious that the placement of the thickenings 14 shown in the figures merely constitutes an example of that placement obtained by the thickenings on flattening of the produced hose when being wound up on, for example, a bobbin. The placement of the thickenings 14 shown in the figures in connection with the flattening of the hose has been selected so as to facilitate the reforming of the hose into a web with sequentially disposed pockets, as described below. The upper edge region of the hose carries reference numeral 15 in the figures.

FIGS. 1*b–f* show embodiments of the upper edge region 15 of the hose and examples of embodiments of the thickenings 14.

FIG. 1*b* shows one embodiment in which the hose has only one thickening 14. This merges into two wings 140 disposed in the longitudinal direction of the hose and projecting out from the thickening 14. Centrally between the wings, there is generally disposed a groove 141 in the outwardly facing surface of the thickening in the longitudinal direction of the hose. The groove entails that the material thickness in the region of the groove is reduced. Hereby, the severing of the hose 1 described below on its reforming into the web 2 comprising a number of mutually sequentially disposed packaging blanks will be facilitated.

FIG. 1*c* shows one embodiment in which the hose has two thickenings 14 disposed in the longitudinal direction of the hose and interconnected with one another. The thickenings are shown in the figure with substantially circular cross-section. Also in this embodiment, a groove 141 is formed between the thickenings corresponding to that described in connection with FIG. 1*b*.

In FIG. 1*d*, the hose is provided in its upper edge with two mutually spaced apart thickenings 14. Between these, the hose forms a material portion of a thickness substantially corresponding to the material thickness of the rest of the hose. In the figure, the thickenings are illustrated in one embodiment with circular cross-section.

FIG. 1*e* shows one embodiment in which the wings 140 are formed by a material strip 142 which is fixed to the hose at its outwardly facing wall surface and which forms the upper edge 13 of the hose. The wall of the hose forms, together with the material strip, the thickening 14 in that region where the material strip is secured to the hose. As a rule, the outwardly facing surface of the thickening 14 formed by the material strip 142 and the wall of the hose is provided with a groove 141 oriented in the longitudinal direction of the hose.

FIG. 1*f* shows one embodiment in which the thickenings 14 are formed by wall portions located in the longitudinal direction of the hose and spaced apart from another, each one being formed as a fold 143 which projects out from the hose. The both opposing walls 143*a*, 143*b* of the folds are fixed to one another by, for example, hot welding. Between the folds, the hose forms a material portion of a thickness which substantially corresponds to the material thickness of the rest of the hose. It will readily be perceived that, in other embodiments, the folds are placed adjacent one another.

It will be obvious to a person skilled in the art that, according to the invention, embodiments of the hose occurs where the thickenings 14 have cross-sections which deviate from those described above,for example are elliptical, oval, polygonal etc.

FIGS. 2, 3 and 3*a–f* illustrate one embodiment of a reforming device 3 which is disposed to reform the hose 1 into the web 2 with mutually sequential packaging blanks, the pockets 26. The pockets are designed so as to be opened, supplied with contents and thereafter closed. The reforming device according to the invention is designed, as a rule, to be interconnected with a filling device 4 or constitute a first part of an apparatus 3, 4 in which the filling device 4 is also included. In the filling device, the pockets are opened for the supply of contents, whereafter they are closed.

The reforming device 3 includes a mechanical retainer device 33 for guiding the upper edge region 15 of the hose 1 (cf. FIGS. 3*a–e*). Beneath the retainer device, there are generally provided two opposing rollers 60*a*, 60*b* which apply forces directed downwards in the figure on the walls 11*a*, 11*b* of the hose. On each side of the hose, there are provided cutting devices 37*a*, 37*b* so as to form longitudinal slits 29 in the walls 11*a*, 11*b* of the hose. The desired downwardly directed force is achieved, in other embodiments, by a rod which is surrounded by the hose 1 and which is of such placing and orientation in relation to the mechanical carrier device 61 that the upper edge region 15 of the hose is stretched over the upper edge surface 611 of the carrier device. Centrally in the mechanical retainer device 33, there is disposed an incision device 38, hereinafter generally referred to as knife 38 for severing the hose in its upper edge 13.

After the cutting device 37*a*, 37*b* and the knife 38, there follows in the direction of displacement of the, hose a punch and welding device 39 which is disposed transversely of the longitudinal direction of the hose. In one preferred embodiment, the punch and welding device is provided with two opposing members 39*a*, 39*b*. The one member 39*a* is designed with a punching knife 39*a* which is oriented transversely of the direction of displacement of the hose and is disposed, on the displacement according to the arrows C of the opposed members, to punch substantially transverse slits 27 through the first and second walls 11*a*, 11*b* of the hose 1 (see FIGS. 2 and 3).

The second member 39*b* constitutes an abutment 39*b* for the punching knife 39*a*. The punching knife also forms a welding device 39*a* for fusing together both walls 11*a*, 11*b* of the hose adjacent the slit 27 made by the punching knife. To this end, the punching knife is provided with heating means (not shown on the drawings) which keep the punching knife at an elevated temperature selected such that, in conjunction with the making of the slit, a fusion of the walls adjacent the slit takes place, whereby they are fixed to one another. It would be obvious to the skilled reader of the specification that the described members and devices for forming the transverse slits 27 and for welding together the walls 11*a*, 11*b* of the hose constitute merely one example of the design of such devices for making the transverse slits and for joining together the walls of the hose.

FIGS. 3*a–f* show the mechanical retainer device 33 in one embodiment in which the retainer device includes two opposing device halves 33*a*, 33*b* which between them form a channel 31 with a downwardly directed gap 34. FIGS. 3*a–c* show in detail the hose 1 inserted in the mechanical retainer device 33. The thickening 14 of the hose is located within the channel 31 formed by the mechanical, retainer device 33. Both walls 11*a*, 11*b* of the hose pass through the downwardly directed gap 34. The mechanical retainer device is shown in one embodiment where a mechanical fixing device 62 (FIG. 3*f*) for a carrier device 61 for the hose 1 as described below is secured between the device halves 33*a*, 33*b*, for example by clamping.

The upper portion 610 of the carrier device is located within the downwardly directed gap 34. Between the carrier device and the bounding definitions of the gap, there are formed two narrow slots 63*a*, 63*b* with a slot width slightly exceeding the wall thickness of the hose 1 but less than the smallest extent of the thickenings. The upper edge surface 611 of the carrier device defines the channel 31 and is disposed substantially flush with adjacent parts of the walls of the channel. As a rule, the edge surface is of convex shape transversely of its longitudinal direction. In the direction of displacement of the hose, the knife 38 is preceded by the carrier device 61.

FIGS. 3*e* and 3*f* show one embodiment in which the knife 38 constitutes a part of the mechanical fixing device 62. The knife 38 is disposed substantially vertically through the channel 31 in a central region thereof. The channel 31 is divided by the knife into a first (forward) channel 31*a* and a second (distal) channel 31*b*.

In order to reform the hose 1 into the web 2, the upper edge region 15 of the flattened hose 1 is passed into the channel 31 of the mechanical retainer device 33 as is apparent from FIG. 3*a*. The hose is displaced in the direction of the arrow A in over the mechanical carrier device 61 by a drive means (not shown in the figures) which generally draws the hose in the longitudinal direction of the device. On their rotation, the rollers 60*a*, 60*b* apply forces against the walls 11*a*, 11*b* of the hose, these forces striving to stretch the hose downwards in the figure. The carrier device 61 ensures that the upper portion of the hose remains in the channel 31. The forces applied by the rollers entail that the hose is stretched over the upper edge surface 611 of the carrier device, whereby the upper edge 13 of the hose is centred such that the thickening 14 assumes a position which entails that, in the illustrated embodiment of the hose 1, the centre of the thickening is cut by the knife 38. The width of the upwardly facing edge surface 611 of the carrier device, i.e. that surface which the carrier device faces towards the channel 31, is adapted to the width of the thickening 14 of the hose, or in the event of more than one thickening 14, adapted to the distance between the two thickenings which are located most proximal the upper edge 13 of the hose.

On cutting of the hose, in cases of only one thickening 14 of the hose (FIG. 1*b*, 1*c*, 1*e*), the thickening is divided into a first part thickening 24*a* and a second part thickening 24*b*, hereinafter occasionally also referred to as forward thickening 24*a* and distal thickening 24*b* (cf. FIG. 3*c*) The forward thickening 24*a* forms the thickening in the upper edge region 15*a* of the first wall 11*a* of the cut hose, and the distal thickening forms the thickening in the upper edge region 15*b* of the second wall 11*b* of the cut hose.

In those embodiments of the hose 1 where the cutting takes place between two spaced apart thickenings of the hose (FIGS. 1*d*, 1*f*), in the cut hose, the forward thickening 24*a* and the distal thickening 24*b* are each located a distance from the upper edge of their respective wall. Between the thickenings and the upper edge of each respective wall, there is formed, on cutting, a band-like portion of substantially the same wall thickness as in those wall portions which are located between the lower edge 12 of the cut hose and the forward or distal thickening 24*a*, 24*b*, respectively.

It will be obvious to a person skilled in the art that a hose 1 which, on being flattened, has received a cross-section in which both walls of the hose no longer have substantially corresponding appearance is still suitable to be inserted in and reformed in the above-described reforming device 3. Examples of hoses of such cross-sections are a flattened hose where only the one wall includes one or more thickenings 14 while the other wall has no such thickenings, or a flattened hose in which the distance of the thickening or thickenings from the edges in the one wall deviates from the distance of the thickening or thickenings from the edges of the other wall. On passage of the hose into the reforming device 3, a reorientation takes place of the thickening or thickenings of the hose such that they, before cutting of the hose takes place, assume those placements which, after the cutting operation, entail the above-described extensions with a forward thickening 24*a* in the upper edge region 15 of the forward wall 11*a*, and a distal thickening 24*b* in the edge region of the distal wall 11*b*.

On this placement of the hose, the cutting devices 37*a*, 37*b* are brought into abutment against each respective wall 11*a*, 11*b* of the hose (cf. FIGS. 3*b*–*e*). In such instance, the carrier device 61 forms an abutment which entails that each respective wall is cut, there being formed slits 29 in the walls 11*a*, 11*b* oriented in the longitudinal direction of the hose.

On the continued displacement of the flattened hose, the hose is moved to a position where the punching and welding devices 39*a*, 39*b* punch the substantially transversely oriented slit 27 in both walls of the flattened hose. The distance between the transverse slits determines the width of the pocket 26 which is formed between two sequentially disposed transverse slits. At the same time as the slit is formed, the punching and welding devices carry,out a welding together of both walls of the hose, there being formed weld joints 25*a*, 25*b* (FIGS. 5, 6) on both sides of the slit thus made. In the direction of displacement of the hose, there is now, before the slit, a commenced pocket whose one edge is welded together and, after the slit, a finished pocket. The finished pocket is suitable to be inserted into the filling device 4 which, as illustrated in FIGS. 2 and 7, is; for example, connected to the reforming device 3. According as the pockets are finished, the web 2 is formed comprising the sequentially disposed pockets. Two embodiments of the web will be described in greater detail below.

The reforming device includes means (not shown in the figures) for displacement of the cutting devices (37*a*, 37*b*) and the punching and welding devices 39. By guiding the cutting devices, the placing and length of the slits 29 disposed in the longitudinal direction of the web are regulated, as well as the distance between them. The same applies for the displacements of the punching devices and for controlling the distance between those points on the flattened hose where the punching devices form the transverse slits 27.

The reforming device makes it possible to produce the web 2 with an adjustable width of the pockets 26 of the web and with longitudinal slits 29 whose lengths are adapted to the size of the openings required in order to supply contents to the pockets 26.

FIGS. 4*a*–*c* show the cross-section d—d in FIG. 3 through an opened pocket 26 in that web 2 which has been produced when the hose in the embodiments illustrated in FIG. 1*b*, 1*f* and 1*e* has been reformed into the web in the reforming device 3.

FIG. 5 shows the web 2 provided with pockets 26 in a first embodiment. and produced employing the reforming device 3. The web 2 of flexible material has two opposing walls 21*a*, 21*b*, hereinafter also referred to as first wall 21*a* and second wall 21*b*, and first (lower) and second (upper) edges 22, 23, respectively located in the longitudinal direction of the web. The sequentially disposed pockets 26 of the web each have a bottom portion 20 at said lower edge 22 and two connection zones or joints 25*a*, 25*b* which are transverse in relation to the longitudinal direction of the web and are occasionally designated transverse joint 25 which form the side closures 25*a*, 25*b* of the pockets.

The web 2 includes two opposing edge portions 28*a*, 28*b* which extend in the longitudinal direction of the web at its upper edges 23*a*, 23*b*. Each one of the edge portions includes the thickenings 24*a*, 24*b* for co-operation with mechanical devices 43, 44 (cf. FIGS. 2 and 4*a–c*) described below in the filling device 4, for guiding the edge portions 28*a*, 28*b* of the web 2 on its displacement in the filling device. The thickenings are occasionally designed as tunnels.

In the foregoing description, it has been disclosed that the web is formed by reforming of a hose 1 which includes at least one thickening 14. It will be obvious that those thickenings 14 in FIG. 1*f* formed as folds in one embodiment may simply form tunnels disposed in the longitudinal direction of the web. This is achieved in that the opposing walls 143*a*, 143*b* of the folds are fixed to one another only in those regions most proximal the wall portions of the hose from which the folds project out.

FIGS. 2, 3 and 4*a–c* also show one embodiment of the filling device 4 which is connected to the above-described reforming device 3. The web formed from the hose with the material thickenings 24*a*, 24*b* is displaced in the direction of the arrow A along the mechanical retainer devices 43, 44 of the filling device. It will be apparent from the figure that, on entry into the filling device 4, the thickening 24*a* of the first wall 21*a* of the, web is guided by mechanical guide means 35*a*, 35*b*. to move a longer distance than the thickening 24*b* of the second wall 21*b* of the web. At the same time, the thickenings 24*a*, 24*b* of the web are displaced away from one another to a distance at most corresponding to the length of the longitudinal slits 29. As a result, the pockets are opened.

FIGS. 4*a–c* show the cross-section d—d in FIG. 3, i.e. a cross-section through the filling device 4 and through a pocket 26 opened by the filling device. On displacement of the web 2 into the filling device, in order to open the pockets 26 of the web, the thickening 24*a* formed by the forward thickening 14*a* of the hose 1 has been separated from the opposing, distal thickening 24*b*. In the reforming device 3, the channel 31 of the retainer device 33 is divided at the knife 38 into two channels 31*a*, 31*b*. These continue in the filling device 4 in a first channel 41*a*, generally referred to as forward channel 41*a* and a second channel 41*b*, generally referred to as distal channel 41*b*. The slots 63*a*, 63*b* continue in the filling device 4 in a first longitudinal gap 42*a* and a second longitudinal gap 42*b* which form downwardly directed gaps for the forward channel 41*a* and the distal channel 41*b* in the mechanical retainer devices 43, 44. The gaps 42*a*, 42*b* have a width slightly exceeding the wall thickness of the web 2 but less than the minimum extent of the thickenings. The forward channel is accommodated in the forward mechanical retainer device 43 and the distal channel in the distal mechanical retainer device 44. Both of the retainer devices are formed by two device halves 43*a*, 43*b* and 44*a*, 44*b*, respectively which surround the channels 41*a*, 41*b*.

On exit from the filling device, tie distal thickening 24*b* of the second wall 21*b* is guided by mechanical guide means 36*a*, 36*b* to travel a longer distance than the thickening 24*a* of the first wall 21*a* of the web. The longer distance which the thickening 24*a* of the forward wall 21*a* is displaced during the entry into the filling device is compensated for by the shorter distance the thickening of the forward wall is displaced on exit. This implies that both walls 21*a*, 21*b* of the web, after the exit of the web out of the filling device assume the same relative positions in the longitudinal direction of the web as prior to entry into the filling device. There will hereby be attained the sought for effect that the opposing walls of the pockets, after exit out of the filling device, assume positions where they are no longer displaced in relation to one another in the longitudinal direction of the web. As a result, on displacement out of the filling device, the walls 21*a*, 21*b* of the web 2 are moved to positions adjacent one another, i.e. to positions in which a reliable and impeccable closure of the pockets takes place in that the walls 21*a*, 21*b* are connected to the material portions 28*a*, 28*b*.

The embodiment of the web 2 illustrated in FIGS. 6, 6*a–c* corresponds substantially to that shown in FIG. 5, but deviates as regards the placing of the longitudinal slits 29. In the web according to FIG. 6, the first wall 21*a* and the second wall 21*b* of the web are both provided with longitudinal slits 29 which, in both walls, depart from each one of the transversely oriented slits 27.

FIG. 7 shows another embodiment of an apparatus 3, 4 including a reforming device 3 and a filling device 4 where the apparatus is designed to handle the web according to the second embodiment illustrated in FIG. 6, 6*a–c*. The reforming device 3 schematically illustrated in the figure wholly corresponds with the reforming device previously described in connection with FIG. 2. The filling device is connected to the reforming device 3. The web with material thickenings 24*a*, 24*b* formed from-the hose in the reforming device is displaced in the direction of the arrow A along the mechanical retainer devices 43, 44 of the filling device.

It will be apparent from the figure that, on entry into the filling device, the thickenings 24*a*, 24*b* in both the first wall 21*a* of the web and in the second wall 21*b* of the web are guided by the mechanical retainer devices 43, 44 out from a centre line B between the mechanical retainer devices 43, 44 of the filling device 4. In such instance, the pockets are open for the supply of the contents (cf. FIGS. 6*a* and 6*c*). On the continued displacement of the web, the two thickenings are guided by the mechanical retainer devices back to the centre line B, i.e. to positions adjacent one another. In such instance, the walls 21*a*, 21*b* of the web assume positions in which closure of the pockets. takes place in that the walls 21*a*, 21*b* are connected in the material portions 28*a*, 28*b*.

In both the apparatus 3, 4 shown in FIG. 2 and FIG. 7, which includes the reforming device 3 and the filling device 4, mechanical retainer devices are. employed in certain embodiments which have a tube or rodlike design. As a result, it is possible to replace the above-disclosed thickenings with tunnels oriented in the longitudinal direction of the hose 1 and the web 2. On displacement of the web, the tunnels surround the mechanical retainer devices and are thereby guided to the desired positions.

It will be obvious that, in the reforming device 3, the size of the openings of the packaging blanks is, adapted simply in response to current needs by the selection of the length and placing of the longitudinal slits of the web. The desired form of the openings of the packaging blanks is simply regulated by adjustment of the distance between the retainer devices of the filling device. Also in the above-mentioned second embodiment of the web, the width of the packaging blanks 26 is adapted to the dimensions of the contents by adjustment of the distance between the transverse slits 27.

In the foregoing description, use has occasionally been made of the designations upper, lower, upwards, downwards, forward, distal, etc. These designations are merely related to the orientation of the apparatuses and devices in the figures and have only been employed to facilitate a presentation of the invention. It will be obvious to a person skilled in the art that the described technology generally permits an optional spatial orientation of the reforming device 3 and thereby as a rule also of the filling device 4.

The foregoing detailed description has referred to but a limited number of embodiments of the invention, but a person skilled in the art will readily perceive that the present invention encompasses a large number of embodiments without departing from the scope of the appended claims.

What is claimed is:

1. Apparatus for forming a hose into a web with sequentially disposed packaging blanks adapted to be opened and filled with filling material by a filling device, the hose having opposite walls with upper and lower longitudinal edges, the hose being closed at the lower longitudinal edge, the walls having upper edges and being joined at said upper edges by a material thickening portion which closes said upper longitudinal edge of the hose, said apparatus comprising:

an elongate mechanical retainer device extending longitudinally for supporting the material thickening portion of said hose to suspend said hose and permit longitudinal advancement of the hose, a slitting device to slit said web at said upper longitudinal edge to separate the upper edges of the opposing walls at said thickening portion so that each wall is provided at its upper edge with a separated thickening portion, said mechanical retainer device extending beyond said slitting device to retain the now separated upper edges of the walls in suspended condition, a cutting device positioned adjacent to said hose for forming longitudinal slits in said walls of the hose, a punching device adjacent to said hose for forming transverse slits in said hose extending from said lower longitudinal edge to respective said upper longitudinal slits, and a welding device for connecting the opposing walls together on both sides of each transverse slit thereby forming a web of successive packages in readiness for being filled at said filling device.

2. The apparatus of claim 1 wherein said retaining device has a channel for supporting said material thickening portion therein and a gap through which said walls of the hose extend, said slitting device being disposed in said channel to slit said hose in said channel.

3. The apparatus of claim 2, wherein said retainer device is divided into two separate portions downstream of said slitter device, each of said separate portions of the retainer device supporting a respective said upper edge of the associated wall.

4. The apparatus of claim 3 wherein said cutting device comprises two cutting members positioned on opposite sides of said walls to cut respective said walls and form said longitudinal slits.

5. The apparatus of claim 3 wherein said slitting device and said cutting devices are supported for adjustable and guided displacement.

6. The apparatus of claim 1 further comprising a carrier device disposed in said gap in the retainer device, said carrier device forming slots in said gap through which said walls respectively extend, each said slot having a width greater than a thickness of the respective said wall and less than a thickness of the respective material thickening portion.

7. The apparatus of claim 1 wherein said channel has a surface at said gap which is dimensioned to support said material thickening portion across said gap while said walls extend through said gap.

8. The apparatus of claim 1 wherein said filling device includes support devices for receiving the material thickening portions of the walls from the separate portions of the retainer device.

9. The apparatus of claim 1 further comprising means for pulling said walls downwardly with said material thickening portion in said retainer device.

10. The apparatus of claim 1 wherein said punching and said welding devices are collectively and respectively formed by a combination punching and welding tool to form said transverse slits and to connect the opposing walls adjacent to said slits in one movement of said tool.

11. The apparatus of claim 1 wherein said material thickening portion of said hose joins said walls at said upper edges thereof, said retaining device supporting said material thickening portion in a centered position in the retaining device so that said slitting device slits the material thickening portion in the center thereof.

12. The apparatus of claim 1 wherein said walls of said hose are formed by folding said hose at said lower longitudinal edge, said walls being joined at said upper edges by said material thickening portion, said retainer device receiving and supporting said material thickening portion as the web is longitudinally advanced therein so that the material thickening portion is slit by said slitting device.

13. The apparatus of claim 1, wherein said slitting device is engaged in said retainer device.

14. A hose adapted for use in the apparatus of claim 1, wherein said hose is supplied to the apparatus in a form in which said upper edges of the walls of the hose are joined together and include the material thickening portion in a region where the walls are joined together so that the walls are separable from one another at said upper edges by the slitting device of the apparatus and thereafter the now separated upper edges can be advanced along the separate mechanical retainer devices of the apparatus.

15. The hose of claim 14, said hose being made of a plastic material.

16. The hose of claim 14 wherein said material thickening portion is formed by a separate strip secured to and joining said walls together at said upper edges.

17. The hose of claim 14 wherein said material thickening portion is integral with the walls of the hose at said upper edges.

18. The hose of claim 17 wherein said material thickening portion has a centering groove at which the material thickening portion can be cut by the slitting device.

19. A method of forming a hose into a web having sequentially disposed packaging blanks adapted to be opened and filled in a filling device, said method comprising:

longitudinally advancing said hose in a condition in which the hose is folded around a lower longitudinal edge to form opposing side walls which are joined at upper edges thereof by a material thickening portion, supporting said hose by said material thickening portion in a suspended state as the hose is advanced, forming spaced longitudinal slits in said walls proximate the upper edges thereof, slitting said walls at said thickened portion to separate the walls at the upper edges thereof and form respective divided portions at the upper edges of each wall, individually supporting each of the divided portions, forming transverse slits in said walls extending from said lower edge of the hose to said longitudinal slits, and joining said opposing walls at said transverse slits to form successive pockets forming said web with sequentially disposed packaging blanks.

20. The method of claim 19 wherein said material thickening portion is slit to form respective divided thickened portions at said upper edges of the walls.

21. The method of claim 13 wherein each wall has a material thickening portion and the hose is slit between the material thickening portions.

22. The method of claim 19 further comprising applying a downward pulling force on the walls of the hose as the hose is being longitudinally and transversely slit and the walls are cut at said material thickening portion.

* * * * *